United States Patent [19]

Tada et al.

[11] Patent Number: 4,674,865

[45] Date of Patent: Jun. 23, 1987

[54] CLEANING DEVICE

[75] Inventors: Hideki Tada, Yokohama; Michio Ito, Hachioji; Kazuki Tanaka; Nobuyuki Kume, both of Yokohama; Tetsuya Takei, Kawasaki; Hiroki Kisu, Ichikawa, all of Japan

[73] Assignee: Canon Kabushiki Kaisha, Tokyo, Japan

[21] Appl. No.: 755,739

[22] Filed: Jul. 17, 1985

[30] Foreign Application Priority Data

Jul. 26, 1984 [JP] Japan ..... 59-157886

[51] Int. Cl.[4] ..... G03G 21/00

[52] U.S. Cl. ..... 355/15; 118/652

[58] Field of Search ..... 355/15, 3 DD, 3 R; 15/256.51, 256.52; 118/652

[56] References Cited

U.S. PATENT DOCUMENTS

| | | | |
|---|---|---|---|
| 3,859,691 | 1/1975 | Katayama et al. | 355/15 X |
| 3,940,282 | 2/1976 | Hwa | 355/15 X |
| 4,181,425 | 1/1980 | Higaya et al. | 355/15 |
| 4,213,617 | 7/1980 | Salger | 355/3 DD |

*Primary Examiner*—R. L. Moses

*Attorney, Agent, or Firm*—Fitzpatrick, Cella, Harper & Scinto

[57] ABSTRACT

A cleaning device in an image forming apparatus for removing developer, dust and/or corona products adhering to a surface to be cleaned includes a cleaning member bearing against a surface to be cleaned to clean the surface to be cleaned, receiving means for receiving magnetic powder removed from the surface to be cleaned by the cleaning member, and magnets provided at the opposite ends of the cleaning member to prevent the magnetic powder removed from the surface to be cleaned by the cleaning member from scattering outwardly.

8 Claims, 5 Drawing Figures

1
1a
1b
2
3
4
4a
4b
5
6
7
9
10
10a
10₁
11
11a
11b
12
12a
12b
13
14
15
20
A
P

CLEANING DEVICE

BACKGROUND OF THE INVENTION

1. Field of the Invention

This invention relates to a cleaning device in an image forming apparatus for removing developer, dust and/or corona products adhering to a surface to be cleaned.

The image forming apparatus may be an electrophotographic copying apparatus, a micro instrument, a laser beam printer or the like. The surface to be cleaned may be the surface of an image bearing member such as a photosensitive drum, a magnetic drum or an insulating drum, or the surface of a member to which developer adheres, such as the surface of a fixing roller. The shape of the image bearing member is not limited to a drum or a roller, but may also be a belt or the like.

2. Description of the Prior Art

Heretofore, in an image forming apparatus utilizing the electrostatic photographic process, it has been the usual practice to charge the surface of an image bearing member by a plurality of corona discharges for the purposes of charging the image bearing member and transferring a toner image to a transfer member. Therefore, the molecules in the air may be varied by the corona discharge to produce substances such as nitrogen oxides. These corona products may adhere to the surface of the image bearing member and under a high-humidity environment, the resistance of the surface of the image bearing member may be reduced to give rise to an adverse effect such as blurring the electrostatic latent image formed on the surface of the image bearing member.

Heretofore, in order to eliminate the above-mentioned adverse effect, there have been proposed a method of heating and drying the image bearing member and a method of disposing a so-called cleaning blade and also rotating a friction roller made of silicone rubber or like material while urging it against the surface of the image bearing member, thereby removing the corona products from the surface of the image bearing member.

Particularly, the latter method is an excellent method in that it has a stable effect in the long-time use of the image bearing member and that it is also effective in removing the substances in a transfer member such as paper adhering to the surface of the image bearing member or toner fused on the surface of the image bearing member.

Any residual toner removed from the photosensitive medium by the cleaning blade is transmitted onto the friction roller, is scraped off therefrom by a scraper and is discharged by a screw, and in this process, toner has been suspended within a cleaning device and has scattered out of the cleaning device. As a method for decreasing such scattering, it would occur to mind to make the lengths of the cleaning blade and the friction roller sufficiently great relative to the width of the image area, but actually it has often been impossible in view of the requirement for compactness of the device to make said lengths sufficiently great. Accordingly, difficulties have remained concerning the countermeasure for said scattering.

SUMMARY OF THE INVENTION

It is an object of the present invention to provide a cleaning device out of which developer does not scatter.

It is another object of the present invention to provide a compact cleaning device.

It is still another object of the present invention to provide a cleaning device which can obtain a good cleaning performance.

DETAILED DESCRIPTION OF THE PREFERRED EMBODIMENTS

The present invention will hereinafter be described in greater detail with respect to an embodiment thereof.

Figure 1:
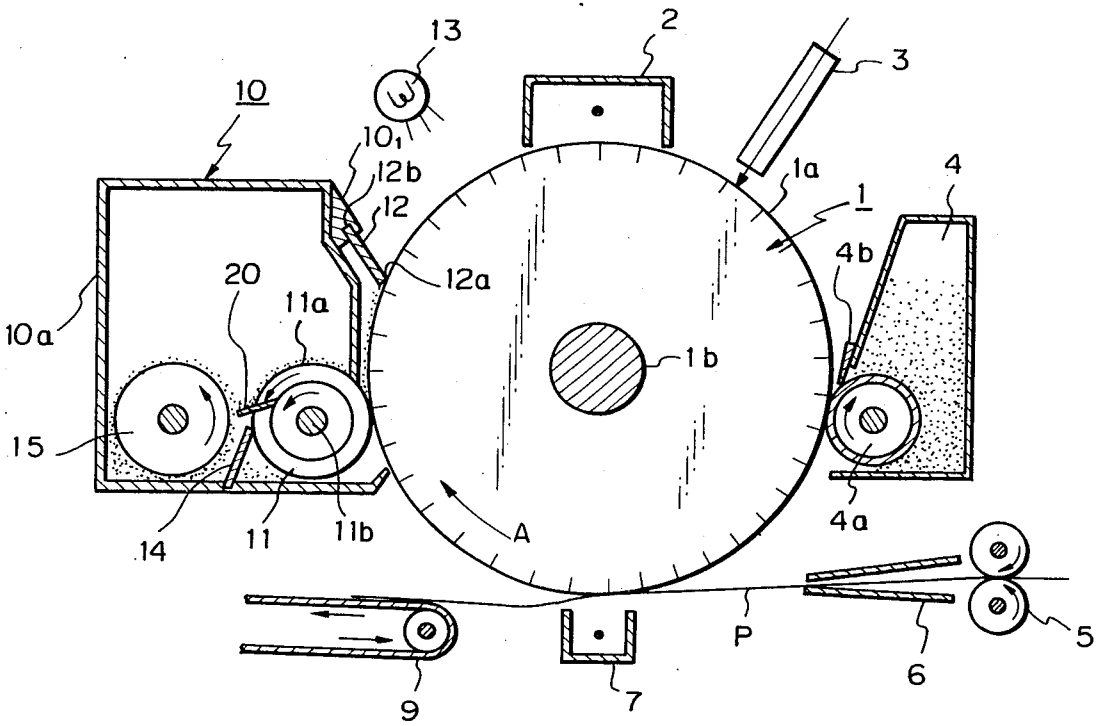
FIG. 1 illustrates the essential portions of an electrophotographic copying apparatus to which a cleaning device according to an embodiment of the present invention is applied.

FIG. 1 illustrates the essential portions of an electrophotographic copying apparatus to which a cleaning device according to an embodiment of the present invention is applied.

In FIG. 1, reference numeral 1 designates an image bearing member which supports thereon a photosensitive medium 1*a* as an electrostatic image bearing member having a photoconductive substance such as Se, OPC or a-Si (amorphous Silicon), the image bearing member 1 being in the form of a drum. This drum-like image bearing member 1 is supported on a shaft 1*b* and is rotatable in the direction of arrow A. Reference numeral 2 denotes a corona discharger for uniformly charging the surface of the photosensitive medium 1*a*. Reference numeral 3 designates optical means such as a short focus optical element array for applying onto the photosensitive medium 1*a* an optical image corresponding to the image of an original. Reference numeral 4 denotes a developing device (using a magnetic developer) for developing an electrostatic latent image formed on the photosensitive medium 1*a* in accordance with the application of the optical image. Reference numeral 4*a* designates a magnet roller, and reference numeral 4*b* denotes a scraper for controlling the erection of the developer on the roller 4*a*. Reference numeral 5 designates a pair of timing rollers which serve to feed a transfer material P fed from feeding means into a transfer station in synchronism with the developed image on the photosensitive medium 1*a*. Reference numeral 6 denotes a transfer material guide, and reference numeral 7 designates a transfer corona discharger for applying to the back of the transfer material P transfer corona opposite in polarity to the toner and effecting the transfer of the toner image to the transfer material P fed into the transfer station 7*a*. Reference numeral 9 denotes a conveyor belt for directing the transfer material P after the termination of the image transfer to fixing means, not shown. Reference numeral 10 designates a cleaning device according to an embodiment of the present invention. First, the photosensitive medium 1*a* from which the toner image has been transferred onto the transfer material P is frictionally contacted by a friction roller 11 (made of silicone rubber or urethane rubber) provided in the cleaning device 10 and having its bearing fixed, whereby substances which adhere to the surface of the photosensitive medium 1*a* and which may cause a blurred image are removed. Thereafter, as the photosensitive medium 1*a* is rotated, any residual toner on the surface thereof is removed by a cleaning blade 12. Thereafter, any residual charge on the surface of the photosensitive medium 1*a* is removed by a pre-exposure lamp 13, and thus the photosensitive medium 1*a* becomes ready for the next cycle. The friction roller 11 is installed in contact with the photosensitive medium 1*a*, and the direction and speed of rotation thereof may be the same as or opposite to the direction and speed of rotation of the photosensitive medium 1. In the embodiment shown, the directions of rotation of the two are opposite to each other. Reference numeral 14 designates a scraper for removing any toner or the like adhering to the surface of the friction roller 11. Further, reference numeral 15 denotes a feed screw for discharging any residual toner, paper powder, etc. accumulated in a cleaning housing 10*a* out of the device 10.

Figure 2:
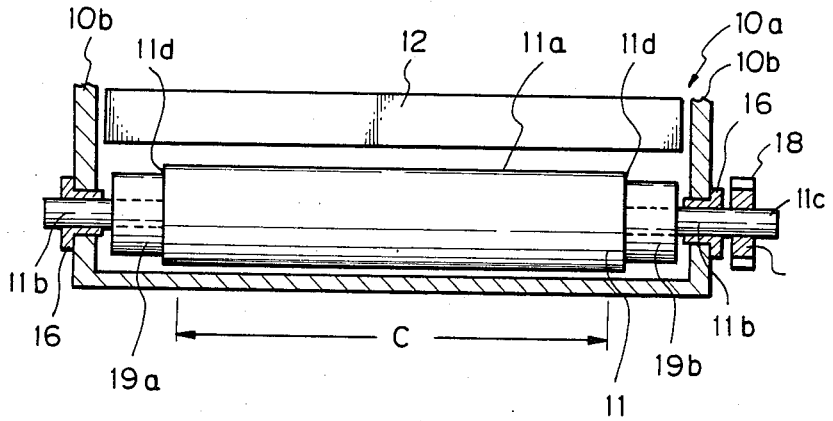
FIG. 2 is a cross-sectional plan view of the essential portions of the cleaning device.
Figure 3:
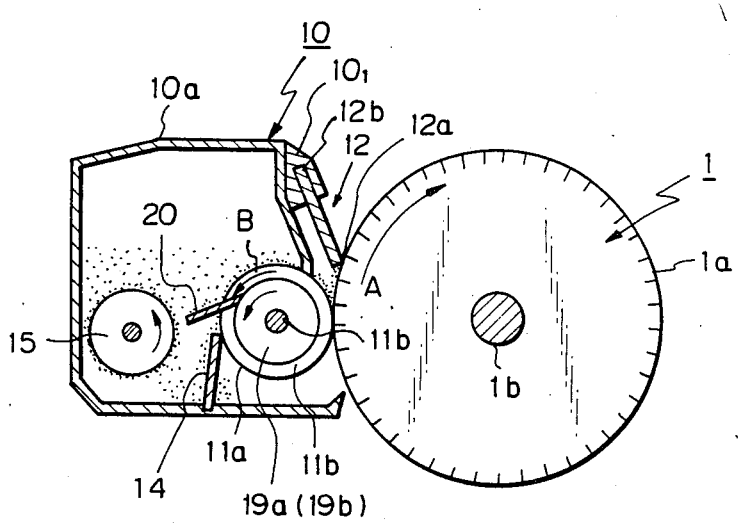
FIG. 3 is a side cross-sectional view of the essential portions of the cleaning device.
Figure 4:
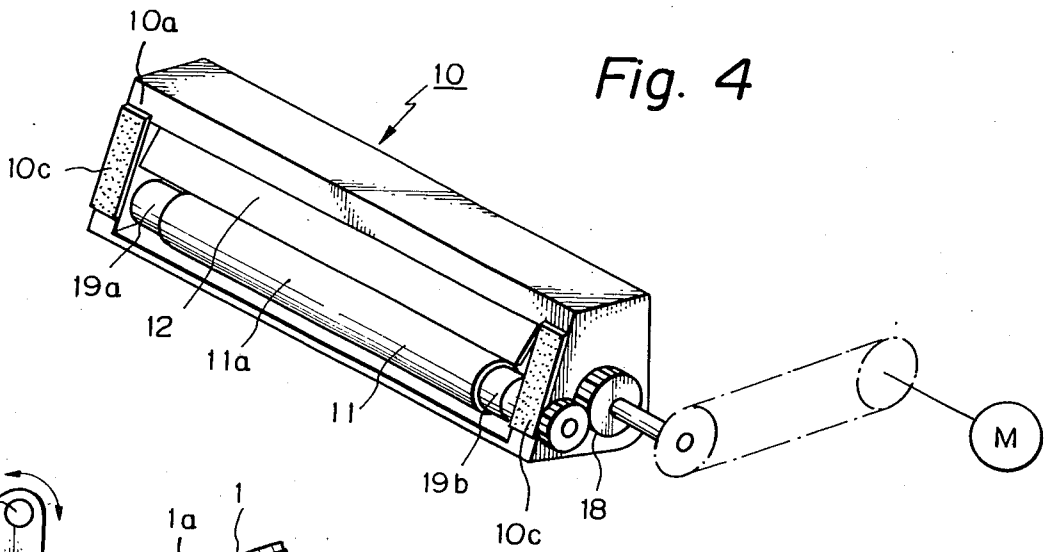
FIG. 4 is a perspective view of the cleaning device according to an embodiment of the present invention.

Reference is now had to FIGS. 2, 3 and 4 to describe the cleaning device according to the present embodiment.

In these Figures, the friction cleaning roller 11 is provided upstream of the blade 12 with respect to the direction of rotation A of the photosensitive drum 1*a*. This friction roller 11 is formed of an elastic material such as silicone rubber or urethane rubber and the peripheral surface 11*a* thereof is in contact with the peripheral surface of the drum 1*a*. As shown in FIG. 2, the rotary shaft 11*c* of this friction roller 11 has its opposite ends 11*b* rotatably held by bearings 16. So, the roller 11 is rotatably mounted on side plates 10*b* by means of the shaft 11*c* and is rotatably driven by a motor M provided on the body side, through a gear train 18. The bearings 16 are provided on the side plates 10*b* of the housing 10*a*. While the direction of rotation of the roller 11 can be suitably selected, it is opposite (arrow B) to the direction of rotation of the drum 1 (arrow A) in the present embodiment. The length of this roller 11 is substantially equal to the image area (indicated by arrow C in FIG. 2) in which the image is formed on the photosensitive medium 1*a*.

Magnet rollers 19*a* and 19*b* held by the shaft 11*c* are provided on the opposite end portions 11*d* of the roller 11. These magnet rollers 19*a* and 19*b* are smaller in diameter than the roller 11 and are provided in opposed relationship with the outside of the image forming area of the photosensitive medium 1*a*. That is, these magnet rollers 19*a* and 19*b* are adhesively secured to the end portions ll*d* of the roller 11 and are fixed to the shaft 11*c* between the end portions ll*d* and the bearings 16. Thus, by rotation of the shaft 11*c*, the friction roller 11 and the magnet rollers 19*a* and 19*b* are rotated together. Also, a scraper 20 is provided in contact with the full width of the peripheral surfaces of the magnet rollers 19*a*, 19*b* to scrape off the toner adhering to the peripheral surfaces of the rollers 19*a*, 19*b*. This scraper 20 is disposed above the scraper 14.

The cleaning blade 12 is provided in the cleaning device 10 above the friction roller 11 (downstream of the friction roller 11 with respect to the direction of rotation of the drum 1). This cleaning blade 12 is formed of an elastic material such as urethane rubber or plastic. The fore end 12*a* of the cleaning blade which bears against the photosensitive medium 1*a* is substantially at a right angle. The rear end 12*b* of the blade 12 is adhesively held by a blade holder portion 10, provided in the cleaning housing 10*a*. This cleaning blade 12 bears against the photosensitive medium 1*a* with its fore end opposed to the direction of rotation of the photosensitive medium 1*a*. Designated by 10*c* is a seal plate made of felt which can prevent the developer from scattering outwardly from the gap between it and the surface of the photosensitive medium.

Operation of the cleaning device according to the present embodiment will now be described.

After the toner image formed on the photosensitive medium 1*a* has been transferred onto the transfer material P, the photosensitive medium 1*a* having residual toner thereon is first frictionally contacted by the peripheral surface 11*a* of the friction roller 11. So, by this frictional contact of the roller 11, some of the residual toner is removed from the photosensitive medium 1*a* and also, corona products, paper powder or fused toner adhering to the photosensitive medium 1*a* is scraped off from the photosensitive medium 1*a* by the roller 11. The residual toner having passed through the nip between the roller 11 and the photosensitive medium 1*a* while adhering to the photosensitive medium 1*a* (usually, the amount of the toner passing through the nip is greater than the amount of the toner scraped off by the friction roller) is scraped off from the photosensitive medium 1*a* by the cleaning blade 12. The toner thus scraped off by the blade 12 falls onto the peripheral surface 11*a* of the friction roller 11, is conveyed toward a conveying screw 15 by rotation of the roller 11, is scraped off from the peripheral surface 11*a* of the roller 11 by the scraper 14 and is discharged outwardly by the conveying screw 15. At this time, the residual toner does not adhere to only the friction roller 11 but moves toward the end portions ll*d* of the friction roller and falls from the friction roller 11 and adheres to the magnet rollers 19*a* and 19*b* on the end portions of the friction roller. This residual toner having adhered to the magnet rollers is scraped off from the peripheral surfaces of the magnet rollers by the scraper 20 for the magnet rollers and is discharged by the conveying screw 15.

Also, the residual toner which has moved to the outside of the image area along the edge portion of the cleaning blade 12 falls to the lower portion of the blade from gravity, and this residual toner is likewise collected by the magnet rollers 19*a* and 19*b* and does not scatter outwardly. Further, even when the toner suspended in the housing 10*a* tries to leak out of the housing, this toner is collected on the peripheral surfaces of the magnet rollers 19*a* and 19*b* by the magnetic force of these magnet rollers and therefore does not scatter outwardly.

The scrapers 14 and 20 will now be described in detail.

The scraper 14 for the friction roller 11 must be as long as at least the length of the friction roller 11, and the scraper 20 for the magnet rollers 19*a*, 19*b* must also be as long as the length of the magnet rollers 19*a*, 19*b*.

The outer diameter $d_1$ of the friction roller 11 and the outer diameter $d_2$ of the magnet rollers 19*a*, 19*b* must be at least in the relation that $d_1 > d_2$ and, depending on the strength of the magnetic force and the magnitude of $(d_1 - d_2)/2$, the scraper 14 for the friction roller 11 may be used also as the scraper for the magnet rollers. That is, where the erection of toner by $(d_1-d_2)/2$ is permitted, it is possible to cut the portion of the erection height of toner which exceeds $(d_1-d_2)/2$ by extending the length of the scraper 14 for the friction roller to the portion of the magnet rollers.

Although the present embodiment has been described with respect to a case where a magnetic developer is used, the magnetic developer may be a two-component developer consisting of a magnetic carrier such as iron powder and a toner, or a single-component developer consisting of only magnetic toner. The present invention is not restricted to magnet rollers, but magnets of any suitable shape may be used.

Figure 5:
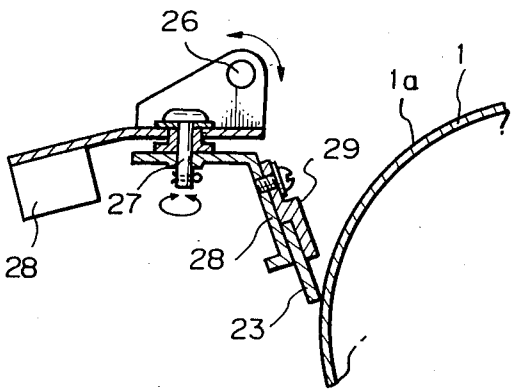
FIG. 5 is a side cross-sectional view of another embodiment of the cleaning blade.

Description will now be made of another embodiment of the cleaning blade which can be applied to the cleaning device. FIG. 5 is a cross-sectional view of the embodiment of the cleaning blade. In the present embodiment, the pressure with which the blade 23 is urged against the photosensitive medium 1*a* is moderately limited to effectively accomplish the scraping-off of the toner by the blade 23 and to prevent the photosensitive medium 1*a* and the blade 23 from being abraded. That is, the blade 23 is biased counter-clockwise about a shaft 26 by the weight of a dead weight 28 into pressure contact with the photosensitive medium 1*a*. The so-called equalizing system in which the blade 23 rotates about a shaft 27 is adopted to bring the blade 23 into contact with the photosensitive medium 1*a* while aligning the blade 23 in the direction of the rotary shaft of the photosensitive medium 1*a* and keeping the contact pressure thereof uniform. Reference numerals 28 and 29 designate blade mounting portions.

Where the so-called equalizing system is employed as in the present embodiment, it is sometimes impossible to install the housing in sufficient proximity to the photosensitive medium, but if the present invention is used, scattering of the toner can be prevented more effectively.

A specific example of the cleaning device using the above-described embodiment will now be described.

A roller made of silicone rubber or urethane rubber was used as the friction roller, and it was rotated at a peripheral speed of 60%–80% or 120% –140% of the peripheral speed of about 180 mm/S of the photosensitive drum (the roller was rotated counterclockwise relative to the drum rotated clockwise). Also, the diameter and length of this friction roller were selected to about 20 mmϕ and about 307 mm, respectively. Further, magnet rollers each having a diameter of about 18 mmϕ and a length of about 12 mm were provided on the opposite end portions of this roller coaxially with the roller. The strength of the magnets of these magnet rollers was about 800–1600 gausses. Also, a stainless steel sheet having a thickness of about 0.05 mm or a polyester sheet having a thickness of about 0.2 mm was used as the scraper for the friction roller. A polyester sheet having a thickness of 0.2–0.3 mm was used as the scraper for the magnet rollers.

By using a cleaning device of such construction, the surface of the photosensitive medium made of amorphous silicon could be cleaned well and the scattering of the toner out of the cleaning device did not occur.

As described above, the present invention provides a cleaning device which does not cause the scattering of magnetic powder such as toner and can clean well the surface of the image bearing member.

What is claimed is:

1. A cleaning device for cleaning a surface of an image bearing member in an image forming apparatus, comprising:

first cleaning means for cleaning said surface of the image bearing member;

second cleaning means having a cleaning roller which rotates while contacting said surface of the image bearing member, said cleaning roller being located upstream of said first cleaning means with respect to a movement direction of said surface of the image bearing member to effect the cleaning of said surface;

a cleaner receptacle on which said first and second cleaning means are mounted, said cleaning receptacle being provided for receiving and containing therein magnetic powder removed from said surface of the image bearing member;

a magnetic member located on a side of said second cleaning means, said magnet member being rotatable to gather magnetic powder removed from said surface of the image bearing member; and a magnetic powder removing member for removing the magnetic powder gathered by said rotatable magnet member.

2. A cleaning device according to claim 1, wherein said cleaning roller is an elastic roller.

3. A cleaning device according to claim 1, wherein another rotatable magnetic member is located at an opposite side of said cleaning roller.

4. A cleaning device according to claim 1, wherein said rotatable magnet member is spaced away from said surface of the image bearing member.

5. A cleaning device according to claim 1, wherein said first cleaning means is a cleaning blade.

6. A cleaning device according to claim 1, wherein said rotatable magnet member is coaxially arranged with respect to said cleaning roller.

7. A cleaning device according to claim 6, wherein said rotating member has an outer diameter smaller than that of said cleaning roller.

8. A cleaning device according to claim 7, wherein another rotatable magnetic member is located at an opposite side of said cleaning roller.

* * * * *

UNITED STATES PATENT AND TRADEMARK OFFICE

CERTIFICATE OF CORRECTION

PATENT NO. : 4,674,865

DATED : June 23, 1987

INVENTOR(S) : HIDEKI TADA, ET AL.

It is certified that error appears in the above-identified patent and that said Letters Patent is hereby corrected as shown below:

COLUMN 6

Line 29, "magnetic" should read --magnet--.
Line 51, "rotating member" should read --rotating magnet member--.

Signed and Sealed this

Fifteenth Day of December, 1987

*Attest:*

DONALD J. QUIGG

*Attesting Officer*

*Commissioner of Patents and Trademarks*